US011837812B2

(12) United States Patent
Saheta

(10) Patent No.: US 11,837,812 B2
(45) Date of Patent: Dec. 5, 2023

(54) CONNECTING TERMINAL TO PRODUCE AN ELECTRIC CONNECTION

(71) Applicant: Connectwell Industries PVT. LTD., Maharashtra (IN)

(72) Inventor: Sandeep Saheta, Mumbai (IN)

(73) Assignee: Connectwell Industries PVT. LTD., Maharashtra (IN)

( * ) Notice: Subject to any disclaimer, the term of this patent is extended or adjusted under 35 U.S.C. 154(b) by 0 days.

(21) Appl. No.: 17/299,521

(22) PCT Filed: Jan. 22, 2019

(86) PCT No.: PCT/IN2019/050049

§ 371 (c)(1),
(2) Date: Jun. 3, 2021

(87) PCT Pub. No.: WO2020/115756

PCT Pub. Date: Jun. 11, 2020

(65) Prior Publication Data

US 2022/0029338 A1 Jan. 27, 2022

(30) Foreign Application Priority Data

Dec. 3, 2018 (IN) ..... 201821045577

(51) Int. Cl.
*H01R 13/426* (2006.01)
*H01R 13/24* (2006.01)
*H01R 13/58* (2006.01)

(52) U.S. Cl.
CPC ..... *H01R 13/426* (2013.01); *H01R 13/2407* (2013.01); *H01R 13/5829* (2013.01)

(58) Field of Classification Search
None
See application file for complete search history.

(56) References Cited

U.S. PATENT DOCUMENTS 9,899,752 B2 * 2/2018 Wu ..... H01R 4/4827
10,333,232 B2 * 6/2019 Wu ..... H01R 9/2416
(Continued)

FOREIGN PATENT DOCUMENTS

CN 102237577 A 11/2011
CN 103001008 A 3/2013
(Continued)

OTHER PUBLICATIONS

Chinese Office Action for Application No. 2023011700998320, dated Jan. 20, 2023, 8 pages.
(Continued)

*Primary Examiner* — Ross N Gushi
(74) *Attorney, Agent, or Firm* — Michael T. Abramson; Jordan IP Law, LLC

(57) ABSTRACT

A connecting terminal (A, B) comprising: a housing (1) comprising a conductor inlet opening (8) configured to receive a conductor (9) to be clamped, the housing (1) comprising a conductor clamping region extending from the conductor inlet opening (8) in an insertion direction of the conductor (9) to be clamped; a current rail (3) disposed in the housing (1) and forming at least a first boundary of the conductor clamping region; and a spring clamp (4) disposed in the housing (1) and configured to exert a clamping force towards the first boundary of the conductor clamping region shall provides a more reliable operation over an extended period of time, in particular with maximum size conductors. To that end, the current rail (3) comprises a first extension (27) forming a second boundary of the conductor clamping region.

9 Claims, 2 Drawing Sheets

(56) References Cited

U.S. PATENT DOCUMENTS

Figure 2:
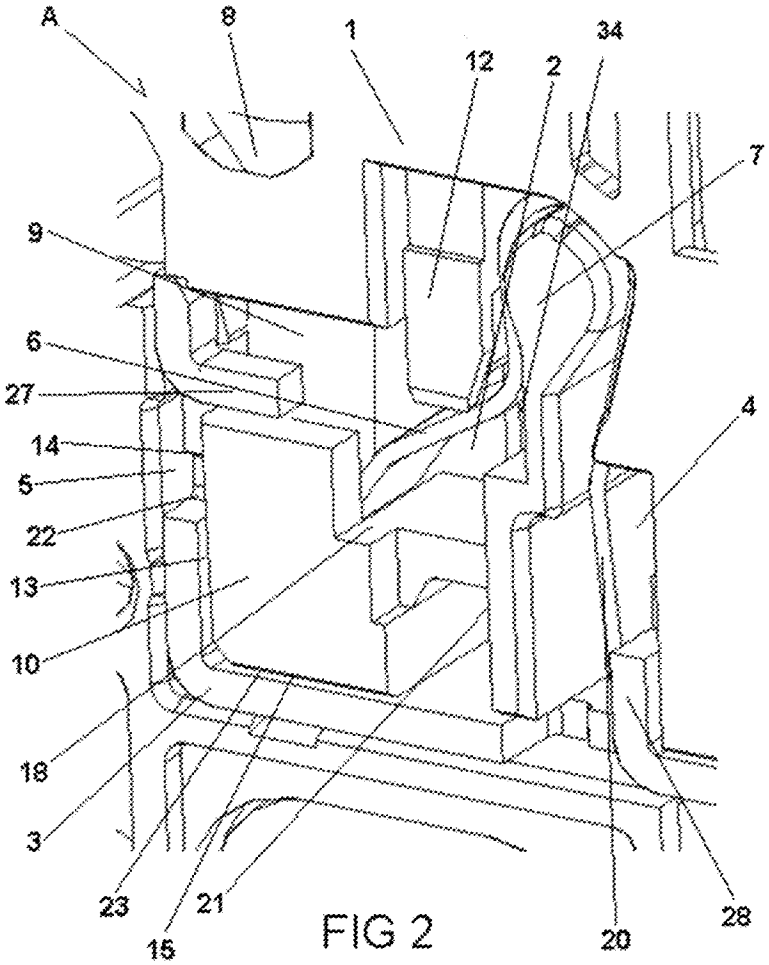

| | | | | |
|---|---|---|---|---|
| 10,396,476 | B2 * | 8/2019 | Stjepanovic ..... | H01R 11/09 |
| 2013/0330985 | A1 | 12/2013 | Wilinski | |
| 2014/0127932 | A1 | 5/2014 | Hoppmann et al. | |
| 2017/0113450 | A1 | 4/2017 | Nass et al. | |

FOREIGN PATENT DOCUMENTS

| | | | |
|---|---|---|---|
| CN | 103608971 | A | 2/2014 |
| CN | 105514642 | A | 4/2016 |
| DE | 102012005465 | B3 | 5/2013 |
| DE | 102015107055 | B3 | 10/2016 |
| DE | 202016100798 | U1 | 5/2017 |
| EP | 2843764 | A1 | 3/2015 |

OTHER PUBLICATIONS

Indian Office Action for Application No. 202117024561, dated Jan. 1, 2023, 5 pages.
European Office Action for Application No. 19707888.4, dated Aug. 7, 2023, 6 pages.

* cited by examiner

CONNECTING TERMINAL TO PRODUCE AN ELECTRIC CONNECTION

CROSS-REFERENCE TO RELATED APPLICATION

The subject application is a U.S. National Phase application of International Application Serial No. PCT/IN2019/050049, filed on 22 Jan. 2019, which claims the priority of India Patent Application No. 201821045577, filed on 3 Dec. 2018. The contents of which are herein incorporated by reference in their entirety.

The invention relates to a connecting terminal comprising a housing comprising a conductor inlet opening configured to receive a conductor to be clamped, the housing comprising a conductor clamping region extending from the conductor inlet opening in an insertion direction of the conductor to be clamped; a current rail disposed in the housing and forming at least a first boundary of the conductor clamping region; and a spring clamp disposed in the housing and configured to exert a clamping force towards the first boundary of the conductor clamping region.

A connecting terminal designed in the way described above serves to clamp a conductor to a current rail by means of a spring clamp in order to produce an electrical connection. When inserting the conductor to be clamped into the conductor inlet opening, the tip of the conductor reaches the clamping region which is bounded by the current rail. It is then pushed between the spring clamp and the current rail and is fixated to the current rail by means of the spring force. Often, the spring clamp is configured in the form of a barbed hook so that the conductor cannot be pulled out easily.

A connecting terminal of the kind described above is known in the prior art. Often, the conductor clamping region is further bounded by a wall of the housing which is extends from the conductor inlet so it covers the side of the clamping region. This extension serves as a guide for both the conductor and the spring clamp during their respective movement.

However, known designs suffer from disadvantages: First, if the spring clamp twists in operation there is a chance that it will "bite" into the plastic surface of the extension and damage it. Because of this damage, the spring operation in subsequent inserting and extracting operations may get obstructed. Second, and even worse, when a maximum size conductor is inserted in the conductor inlet, the spring is deflected to its extreme position. In this position there is a chance that the spring reaches a position in which it was inserted and thus may come out of the plastic body as there is no restriction available in the lateral direction.

The problem the invention wants to solve is therefore to provide a connecting terminal of the kind described above which provides a more reliable operation over an extended period of time, in particular with maximum size conductors.

This problem is inventively solved by the current rail comprising a first extension forming a second boundary of the conductor clamping region.

The invention is based on the idea that the problem of the spring clamp leaving its position when a maximum size conductor is inserted is caused by the specific way of assembling the terminal connector: In the prior art, the spring clamp is fitted inside the plastic housing by compressing it and then inserting it through an opening in the side of the plastic housing which has the same contour as the compressed spring clamp. After the spring clamp is inserted, it is then released inside the plastic body and expands towards the clamping region. However, as indicated above, if a maximum sized conductor is inserted into the terminal, the spring may be compressed into its original inserting position and fall out through the still existing opening. To prevent this, the opening through which the spring is inserted should be closed. However, this should by done without complicating the assembly process. The inventors have recognized that this is possible by modifying the current rail which is also inserted into the plastic housing. The current rail comprises an extension that also bounds the conductor clamping region. Since the current rail is inserted afterwards, its extension can seal the opening through which the spring clamp was inserted.

In addition, the extension of the current rail also solves the second problem mentioned above: The "biting" of the spring clamp into the housing is mainly caused because the housing is made of plastic and plastic is a softer surface material than the spring material. Since the extension of the current rail now serves as a guide for the spring clamp and is made of a harder material, the spring clamp cannot damage its surface.

Advantageously, the first boundary of the conductor clamping region which comprises the current rail plane is perpendicular to the second boundary created by the extension. In other words: The extension extends perpendicularly from the current rail plane. In this way, the extension can serve perfectly as a guide for the spring because it extends in the direction of the spring clamp movement.

Furthermore, the housing advantageously comprises a first wall forming a third boundary of the conductor clamping region, wherein the first and third boundaries are located on opposite sides of the conductor clamping region. The spring clamp movement is therefore guided on one side by the extension of the current rail, and on the other side by the wall of the housing.

Advantageously, the first extension of the current rail is configured to limit a movement of the spring clamp in a direction perpendicular to the direction of the clamping force. In particular, this means that it is located such that it indeed guides the movement of the spring clamp, i.e. adjacent to at least the tip of the spring clamp, and is dimensioned such that it remains in close contact with at least the tip of the spring clamp even if the spring clamp is compressed by insertion of a conductor.

Furthermore, the current rail is advantageously L-shaped in the vicinity of the conductor clamping region. In other words, it is configured as a band that bends around the conductor clamping region in a 90° angle. This does not exclude that the current rail does have other forms further away from the conductor clamping region.

In a first advantageous embodiment, the first extension of the current rail forms a cantilever located adjacent to a first end of the spring clamp. This means that the extension is configured in the style of a small bar that extends over the spring clamp tip and guides its movement there.

Furthermore, in an embodiment with an L-shaped current rail, advantageously the first extension extends from a first leg of the L-shaped current rail and additionally, the current rail advantageously comprises a second extension extending from a second leg of the L-shaped current rail and forming a cantilever located adjacent to a second end of the spring clamp. Thus, there are two extensions of the current rail, one at each leg of the L-shaped current rail, each of them guiding and holding one tip of the spring clamp. That way, both ends of the spring clamp are fixated after insertion of the current rail into the housing.

Furthermore the housing comprises a second wall extending the second boundary of the conductor clamping region, i.e. of the boundary defined by the extension. In other words, the second wall forms a plastic surface which also guides the spring clamp. The extension of the current rail and the plastic surface lie in the same plane so that they together form a spring guiding surface.

In a second, alternative advantageous embodiment, the first extension forms a bridge connecting the first leg and the second leg of the L-shaped current rail. This way, there is no need for an additional housing surface to guide the spring clamp. The bridge connecting both legs of the L-shaped current rail may be configured broad enough to guide the spring clamp over its entire movement range.

In order to allow the abovementioned assembly of the connecting terminal, the housing comprises a spring clamp insertion opening which extends along the entire contour of the spring clamp when no conductor is clamped in the conductor clamping region. The opening is located in the plane of the first extension and therefore, when the current rail is not yet inserted into the housing, the spring clamp can be inserted. After the spring clamp is inserted into the housing, the current rail is inserted.

The first extension then advantageously covers at least part of the spring clamp insertion opening such that the inserted spring clamp is securely guided and secured inside the housing.

In an advantageous embodiment the housing is made of a plastic material. It can be produced in large quantities e.g. by casting, injection molding or by 3D-printing. The housing advantageously forms a one-piece arrangement with all abovementioned parts of it.

The spring clamp and/or the current rail are advantageously made of a metallic material. The current rail is designed to carry electric current.

Advantageously, a method of manufacturing the connecting terminal described above comprises the steps of providing the housing; inserting the spring clamp through the spring clamp insertion opening; installing the current rail such that the first extension limits a movement of the spring clamp in a direction perpendicular to the direction of the clamping force.

A computer-readable file advantageously comprises instructions which, when loaded by a computer, cause a 3D-printer under the control of the computer to print a housing suitable for the described connecting terminal. This means that the housing comprises the features described above as being part of the housing. A corresponding file comprises a 3D model of the housing and can for example be provided for download on the internet. A such file may for example be a STL (Standard Triangulation Language) file and may be loaded into a Computer Aided Design software.

The advantages achieved by the present invention are in particular that by replacing a part of the plastic housing which partly bounds the conductor clamping region by an extension of the current rail in order to guide the movement of the spring clamp in the connection terminal, the spring clamp can be securely fastened and guided, and can cause no damages in the interior of the housing which would hamper movement of the spring clamp.

Furthermore, the metal extension of the current carrying element helps in making a secondary contact of the conductor with the current rail which is in addition to the lateral connection area that is available in the design. Thus, the electrical connection is also improved.

Figure 1:
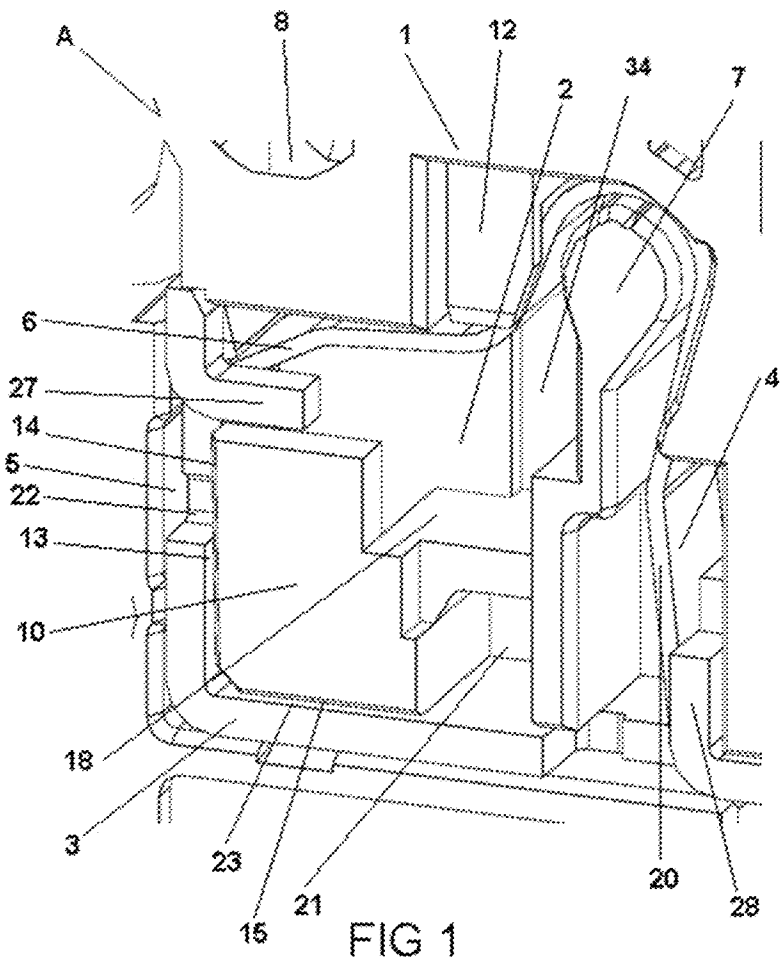
Figure 4:
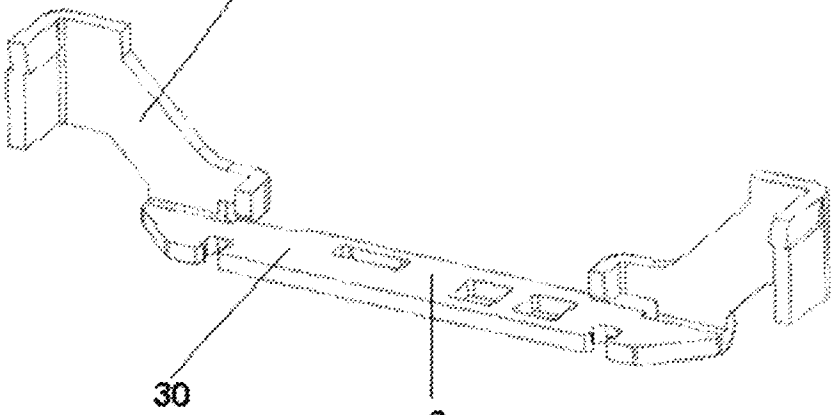
Figure 3:
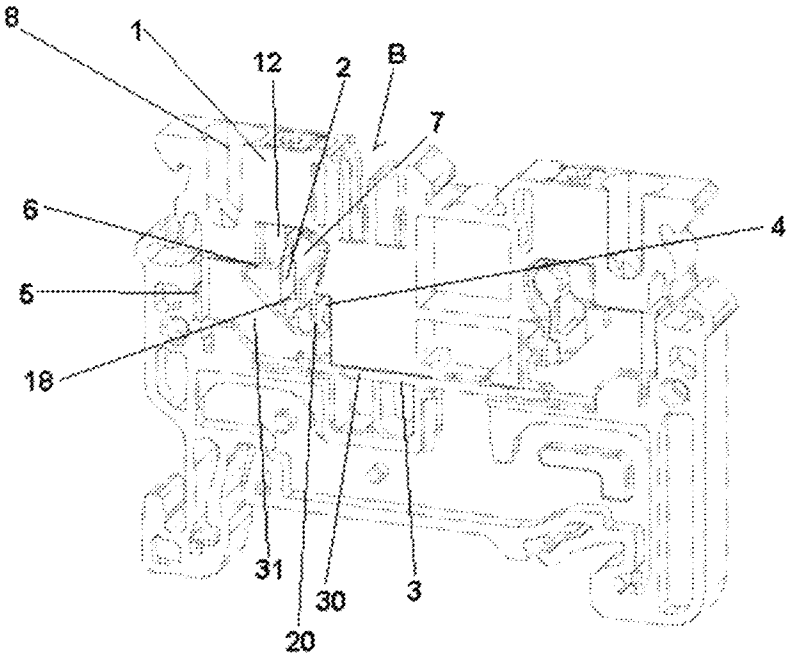

Exemplary embodiments of the invention are described in the following in relation to figures, in which FIG. 1 shows a partial view of a connection terminal with a cantilever-style extension of the current rail, FIG. 2 shows a partial view of the connection terminal of FIG. 1 with an inserted conductor, FIG. 3 shows a full view of a connection terminal with a bridge-style extension of the current rail, and FIG. 4 shows a full view of the current rail of the connection terminal of FIG. 3.

FIGS. 1 and 2 show a schematic partial view of a connecting terminal A, wherein FIG. 1 shows the arrangement without an inserted conductor and FIG. 2 shows the arrangement with an inserted conductor. In FIGS. 1 and 2, only the part of the connecting terminal A comprising the conductor clamping region is shown in order to describe the function of the clamping mechanism. The connecting terminal A has a housing 1 cast as one piece from a plastic material. The housing 1 has an interior clearance 2. In the interior clearance 2 of the housing 1, a current rail 3 and a spring clamp 4 are arranged.

The current rail 3 is formed from a narrow metal band and bent in the shape of an L. In its state when inserted into the housing 1, as shown in FIG. 1, the current rail 3 is positioned against an interior wall 5 of the housing 1. As can be seen in FIG. 1, the housing 1 has an opening 21 on one longitudinal lateral face, so that the housing is open at the side. The housing 1 is thus open on one side. The current rail 3 is inserted into the housing via this side opening 21. The back side of the housing 1 is completely closed The spring clamp 4 is designed in the form of a leg spring with a retention leg 20 and a clamping member 6. The spring clamp 4 is pushed open onto a retention element 7 formed in the housing 1, which retention element 7 is formed integrally with the housing 1. In order to slide the spring clamp 4 onto the retention element 7, the spring clamp 4 is also inserted into the housing 1 via the side opening 21.

In the housing 1 itself, a conductor inlet opening 8 is formed, via which a conductor 9 to be clamped, as shown in FIG. 2, can be inserted in order to be clamped against the current rail 3 by means of the clamping member 6 of the spring clamp 4.

Furthermore, the connecting terminal A has a spring guiding surface on its front side in FIG. 1 and FIG. 2 which serves as a guide for the spring clamp 4 during its movement, and also as a guide for the conductor 9 to be clamped. The spring guiding surface comprises two parts that are arranged in a common plane: The first part is a front plastic surface 10 forming an essentially flat wall. The front plastic surface is formed as a cantilever from the bottom and is free to deflect on the top side. The second part of the spring guiding surface is a first metal extension 27 formed as a cantilever which extends perpendicularly from the leg of the L-shaped current bar 3 which is adjacent to the conductor clamping region. The first metal extension 27 is located directly adjacent to the spring clamp 4 and covers the spring clamp 4 from the front side of the housing 1.

The spring guiding surface comprising the metal extension 27 and the front plastic surface 10 is formed such that it laterally borders, in the direction of the side opening 21 in the housing 1, the conductor clamping region formed between the clamping member 6 and the current rail 3. The clamping member 6 of the spring clamp 4 and the lateral face 13 of the current rail 3, to which the conductor 9 is clamped, are located opposite one another such that the spring guiding surface is arranged off-centre between the clamping member 6 of the spring clamp 4 and the current rail 3.

As can be seen in FIG. 2, the conductor 9 to be clamped is inserted from above into the conductor clamping region between the clamping member 6 and the current rail 3, the conductor 9 being guided between the back wall 34 and the metal extension 27. A lateral slipping or sliding of the conductor 9 to be clamped, out of the clamping region, can be prevented.

Furthermore, the spring guiding surface comprising the metal extension 27 and the front plastic surface 10 acts as a retainer for the spring clamp 4 since the spring clamp 4 is prevented from sliding forwards from the retention element 7. For the first few millimeters of spring displacement when the conductor 9 is inserted, this is achieved by the metal extension 27 since the clamping member 6 of the spring clamp 4 is arranged behind the metal extension 27 and can be activated there by means of the conductor 9 or a release tool, for example a trigger 12. Thus, if the clamping member 6 twists on insertion of the conductor 9, it will be first guided and restricted by the metal extension 27 of the current rail 3. It gets further support from the cantilevered front plastic surface 10. However, the main guiding force comes from the metal extension 27. Due to this, even if the spring clamp 4 twists, it cannot "bite" into the front plastic surface 10 as the metal extension 27 will restrict it. Hence, no structural damage can happen to the front plastic surface 10, thereby ensuring smooth subsequent spring actions.

The front plastic surface 10 is formed at a distance from the interior wall 5 of the housing 1, such that a clearance or gap 22 is formed between the longitudinal side 14 of the front plastic surface 10, which side points towards the interior wall 5 of the housing 1, and the interior wall 5 of the housing 1 in the clamping direction of the clamping member 6 of the spring clamp, as well as a clearance or gap 23 between the lower side 15 of the front plastic surface 10 and the interior wall 5, formed as the floor surface, of the housing 1 in the conductor insertion direction. The current rail 3 can be inserted into the housing 1 via the gap 22 and the gap 23 between the conductor guide 10 and the interior wall 5 of the housing 1.

In its inserted state, the current rail 3 is fastened to the housing 1 by a latching mechanism (not shown). The current rail 3 also has a second metal extension 28 located on the lower leg of the L-shaped current rail 3. It is formed just as the first metal extension 27, i.e. as a perpendicular cantilever extending from the current rail in the plane of the spring guiding surface. However, the second metal extension is located adjacent to the tip of the retention leg 20 such that it prevents a side movement of the retention leg 20. From FIG. 1 and FIG. 2, it is apparent that the side opening 21 of the housing 1 comprises the entire contour of the spring clamp 4. Thus, with the current rail 3 and in particular with its two extensions 27, 28 removed, the spring clamp 4 can be easily removed from the housing 1 through the opening 21. However, with the current rail 3 installed, the extensions 27, 28 securely fixate the tips of the clamping member 6 and the retention element 7 in the housing because they cover the opening 21 over these two tips.

In the housing 1, adjacent to the front plastic surface 10, a spring limiting element 18 is formed, which is integrally moulded with the housing 1. The spring limiting element 18 limits the maximum deflection of the clamping member 6 of the spring clamp 4 (see spring clamp position in FIG. 2) and projects at an angle of substantially 90° relative to the conductor guide, into the interior clearance 2 of the housing 1. As can be seen in FIGS. 1 and 2, the spring limiting element 18 is connected to the front plastic surface 10.

Referring to FIGS. 1 and 2 and the design of the opening 21 and the extensions 27, 28 described above, the production of the connecting terminal A is described in the following. The housing 1 with all described plastic parts is injection molded or cast or 3D-printed in one piece. To the latter end, a 3D model file is provided to a computer with a 3D printer attached. Then, the spring clamp 4 is inserted via the opening 21. Thereafter, the current rail 3 is inserted so that the extensions 27, 28 fixate the tips of the clamping member 6 and the retention element 20. As a result of these two restrictions the spring clamp 4 can never get dislodged and come out of the plastic housing 1 even when a maximum size conductor is inserted.

FIGS. 3 and 4 show an alternative embodiment of a connecting terminal B. First, FIG. 3 shows the entire outside contour of the housing 1 which is identical to the contour of the housing 1 of the embodiment of FIG. 1 and FIG. 2. As can be seen, there are two conductor inlet openings 8 and two conductor clamping regions in a basically mirror symmetric arrangement, such that the current rail 3 will have two L-shaped parts which together are U-shaped.

In the following, the embodiment of FIGS. 3 and 4 is only explained based on its differences to the embodiment of FIGS. 1 and 2. First, the current rail 30 is designed differently: The two extensions 27, 28 of the current rail 3 from FIGS. 1 and 2 are connected integrally by a broad bridge 31 which diagonally links the two legs of the L-shape. As a result, the L-shape is broken and misses the 90° edge part.

As can be seen in FIG. 3, the broad bridge 31 now entirely forms the spring guiding surface. There is no need and no room for a front plastic surface 10. Instead, the bridge 31 guides the conductor 8 and the spring clamp 4 during operation. The embodiment of FIG. 3 and FIG. 4 provides even better guidance for the spring clamp 4 and a larger metal contact area for the conductor 8.

LIST OF REFERENCE SIGNS

A, B connecting terminal
1 Housing
2 Interior clearance
3 Current rail
4 Spring clamp
5 Interior wall
6 Clamping member
7 Retention element
8 Conductor inlet opening
9 Conductor
10 Front plastic surface
12 Trigger
13 Lateral face
14 Longitudinal side
15 Lower side
18 Spring limiting element
20 Retention leg
21 Opening
22 Gap
23 Gap
26 Clearance
27 Extension
28 Extension
30 Current rail
31 Bridge

The invention claimed is:

1. A connecting terminal comprising:

a housing comprising a conductor inlet opening configured to receive a conductor to be clamped, the housing comprising a conductor clamping region extending from the conductor inlet opening in an insertion direction of the conductor to be clamped;

a current rail disposed in the housing and forming at least a first boundary of the conductor clamping region;

a spring clamp disposed in the housing and configured to exert a clamping force towards the first boundary of the conductor clamping region; and a retention element onto which the spring clamp is slid and a spring limiting element which limits the maximum deflection of a clamping member of the spring claim, wherein both the retention element and the spring limiting element are formed integrally with the housing, wherein the current rail comprises a first extension forming a second boundary of the conductor clamping region and the housing comprises a second wall extending the second boundary of the conductor clamping region, wherein the second wall forms a plastic surface and the first extension of the current rail and the plastic surface lie in the same plane so that they together form a spring guiding surface wherein the housing comprises a spring clamp insertion opening which extends along the entire contour of the spring clamp when no conductor is clamped in the conductor clamping region, and wherein the first extension forms a cantilever located adjacent to a first end of the spring clamp and covers at least part of the spring clamp insertion opening.

2. The connecting terminal of claim 1, wherein the first boundary is perpendicular to the second boundary.

3. The connecting terminal of claim 1, wherein the housing comprises a first wall forming a third boundary of the conductor clamping region, wherein the second and third boundaries are located on opposite sides of the conductor clamping region.

4. The connecting terminal of claims 1, wherein the first extension (27) is configured to limit a movement of the spring clamp (4) in a direction perpendicular to a direction of the clamping force.

5. The connecting terminal of claim 1, wherein the current rail is L-shaped with two legs, wherein L-shaped includes a bridge separating each of the two legs.

6. The connecting terminal of claim 1, wherein the first extension extends from a first leg of the L-shaped current rail and wherein the current rail comprises a second extension extending from a second leg of the L-shaped current rail and forming a cantilever located adjacent to a second end of the spring clamp.

7. The connecting terminal of claim 1, wherein the housing is made of a plastic material.

8. The connecting terminal of claim 1, wherein the spring clamp and/or the current rail are made of a metallic material.

9. A method of manufacturing the connecting terminal of claim 1, comprising:

providing the housing;

inserting the spring clamp through the spring clamp insertion opening; and installing the current rail such that the first extension limits a movement of the spring clamp in a direction perpendicular to a direction of the clamping force.

* * * * *